US005881399A

United States Patent [19]

Kartoleksono et al.

[11] Patent Number: 5,881,399

[45] Date of Patent: Mar. 16, 1999

[54] DUAL FLUSH ASSEMBLY FOR WATER CLOSETS

[75] Inventors: B. Prabowo Kartoleksono, Jakarta; Slamet Riyadi, West Jave, both of Indonesia

[73] Assignee: American Standard, Inc., Piscataway, N.J.

[21] Appl. No.: 647,488

[22] Filed: May 14, 1996

[30] Foreign Application Priority Data

Jan. 15, 1996 [ID] Indonesia ..... P-960093

[51] Int. Cl.[6] ..... E03D 1/14

[52] U.S. Cl. ..... 4/326; 4/324

[58] Field of Search ..... 4/326, 324, 325, 4/405, 410

[56] References Cited

U.S. PATENT DOCUMENTS 2,839,759 6/1958 Martino ..... 4/326

5,333,332 8/1994 Kam ..... 4/326

FOREIGN PATENT DOCUMENTS

WO 91/12381 8/1991 European Pat. Off. ..... 4/326

*Primary Examiner*—David J. Walczak

*Attorney, Agent, or Firm*—Elaine Brenner Robinson

[57] ABSTRACT

A dual flush mechanism equipped with a two independent flush valves which are each separately controlled by a separate spring loaded button. The flush valves are at different heights in the toilet tank such that actuation of the upper flush valve, by pressing a first button on top of the tank, will produce a short flush, while pressing of the second button will actuate the lower flush valve to produce a long flush. Pivot rods are pivotably supported on a common axis below the first and second buttons. The upper end of each pivot rod is coupled through a spring to its respective push button on top of the tank. The opposite ends of the pivot rods are coupled respectively through a chain to the upper and lower flush valves. Pressing the first button exerts a downward force through the spring on the first pivot rod to raise the opposite end thereof which in turn raises the upper flush valve. Pushing the second button actuates the second pivot rod in the same manner to raise the lower flush valve. The height of the upper flush valve can be adjusted.

7 Claims, 6 Drawing Sheets

DUAL FLUSH ASSEMBLY FOR WATER CLOSETS

BACKGROUND OF THE INVENTION

The present invention relates generally to a flushing device for water closets and more particularly to a water closet flushing device with a dual flush mechanism which uses a dual flush valve equipped with a height regulator.

Various dual flush mechanisms have been developed over the years for the purpose of providing the option of a full or long flush cycle for solid waste, or a short or partial flush cycle for liquid waste to save water during flushes that do not require the use of a full flush cycle. Conservation of natural resources such as water is important. Water closets which use less water to flush waste are most desirable.

Dual flush mechanisms have been constructed with two flush valves whereby each valve is operated by a separate knob or handle. The flush valves may be placed at different heights with respect to the bottom of the closet's tank. The actuation of the knob linked to the upper valve will produce a short or partial flush, while the actuation of the lower flush valve will produce a long or full flush. The length of the flush cycle is a function of the height of the flush valves with respect to the closet's bottom wall. The higher the valve is from the closet's bottom wall, the smaller the volume of water that will be discharged. Accordingly, the flushing of liquid waste, for example, requires the pressing of the upper flush valve operating knob since only a small amount of water is required for the flushing, while the flushing of solid waste requires the pressing of the knob linked to the lower flushing valve whereby a longer flush or a larger volume of flush water is produced. In this way, water conservation is ensured.

U.S. Pat. No. 5,333,332 to Kam, discloses a dual flush valve system in a closet using separate flush valve operating knobs. The system includes at least eight hinge points located between the lower and upper flush valve knobs and operating rods which effect a long or a short flush. Although there is a distinction between the short flush and long flush cycles, the dual flush system is very complicated, having many hinges operating the flush valve rod such that damage or failure of any of the hinges will effect failure of the overall function.

U.S. Pat. Nos. 2,839,759 and 2,864,095, both issued to the same inventor, Martino, disclose dual flush valves in which the base of the upper valve is controlled by means of a groove that regulates different heights of water in the closet tank. However, the structure of the valve rod operating hinges and the distance between the operating knobs are unable to ensure optimum performance. U.S. Pat. No. 3,795,016, discloses a water closet with dual flush valves which enable telescopic control, or lengthening or shortening, of the upper valve, which is strongly fixed by means of flanged bolts. In this invention, the arrangement of the flush valve operating hinges and the use of a single knob for operating the flush valve combine to give convenience to the user. However, the construction of the valve system is relatively complicated and the potential failure of the upper and lower flush valve operating hinges due to inadvertent excessive pressure on the knob can cause a large discharge of water.

Furthermore, U.S. Pat. No. 4,829,605 to Agustino, also discloses a dual flush valve having dual levers. One of the levers is for operating the half-volume flush valve and the other is for operating the full-volume flush valve. The two levers function as pressing knobs which are fixed in a non-parallel row. This invention does not give importance to the construction of the hinges of the lever or rod used for operating the individual valves. U.S. Pat. No. 4,011,604 to Goldswarthy relates to a dual flush system for closets with a lever operating construction that drives the flush valves separately. The weakness of the construction is in the length of the operating rod with respect to the handle or pressing knob. It is possible that the operating hinge which forms an "upside-down U" could lessen the operating capacity of the two flushing valves.

Accordingly, an improved dual flush mechanism that reduces unnecessary water consumption and which is of sound, simple construction is desired. It is preferable that the height of the mechanism be adjustable to accommodate the variation in tank size.

SUMMARY OF THE INVENTION

It is therefore an object of the invention to provide a dual flush mechanism of simplified construction.

It is a further object to provide an adjustable dual flush mechanism which may be adjusted to adapt to certain tank variations.

These and other objects are achieved by the present invention which provides a dual flush mechanism including two independent flush valves which are each separately controlled by a separate spring loaded button. The flush valves are at different heights in the toilet tank such that actuation of the upper flush valve by the press of a first button on top of the tank will produce a short flush, while the press of a second button will actuate the lower flush valve to produce a long flush.

Pivot rods are pivotably supported on a common axis below the first and second buttons. The upper end of each pivot rod is coupled through a spring to its respective push button on top of the tank. The opposite ends of the pivot rods are coupled respectively through a chain to the upper and lower flush valves. Pressing the first button exerts a downward force through the spring on the first pivot rod to raise the opposite end thereof which in turn raises the upper flush valve. Pushing the second button actuates the second pivot rod in the same manner to raise the lower flush valve.

The height of the upper flush valve can be adjusted.

BRIEF DESCRIPTION OF THE DRAWINGS

The invention will be more fully appreciated from the following detailed description when the same is considered in connection with the accompanying drawings in which.

DETAILED DESCRIPTION OF THE INVENTION

Figure 1C:
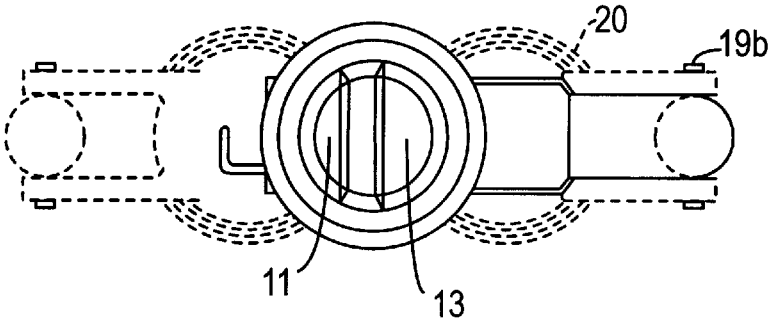
FIG. 1C is a top plan view of the knob member with the valve members shown in phantom.
Figure 1B:
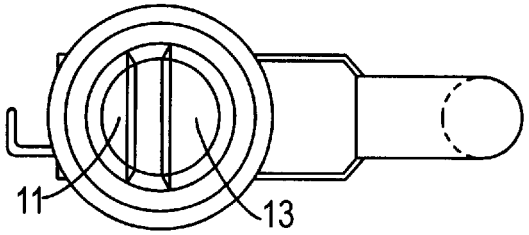
FIG. 1B is a top plan view of the knob member of the flush valve.
Figure 1A:
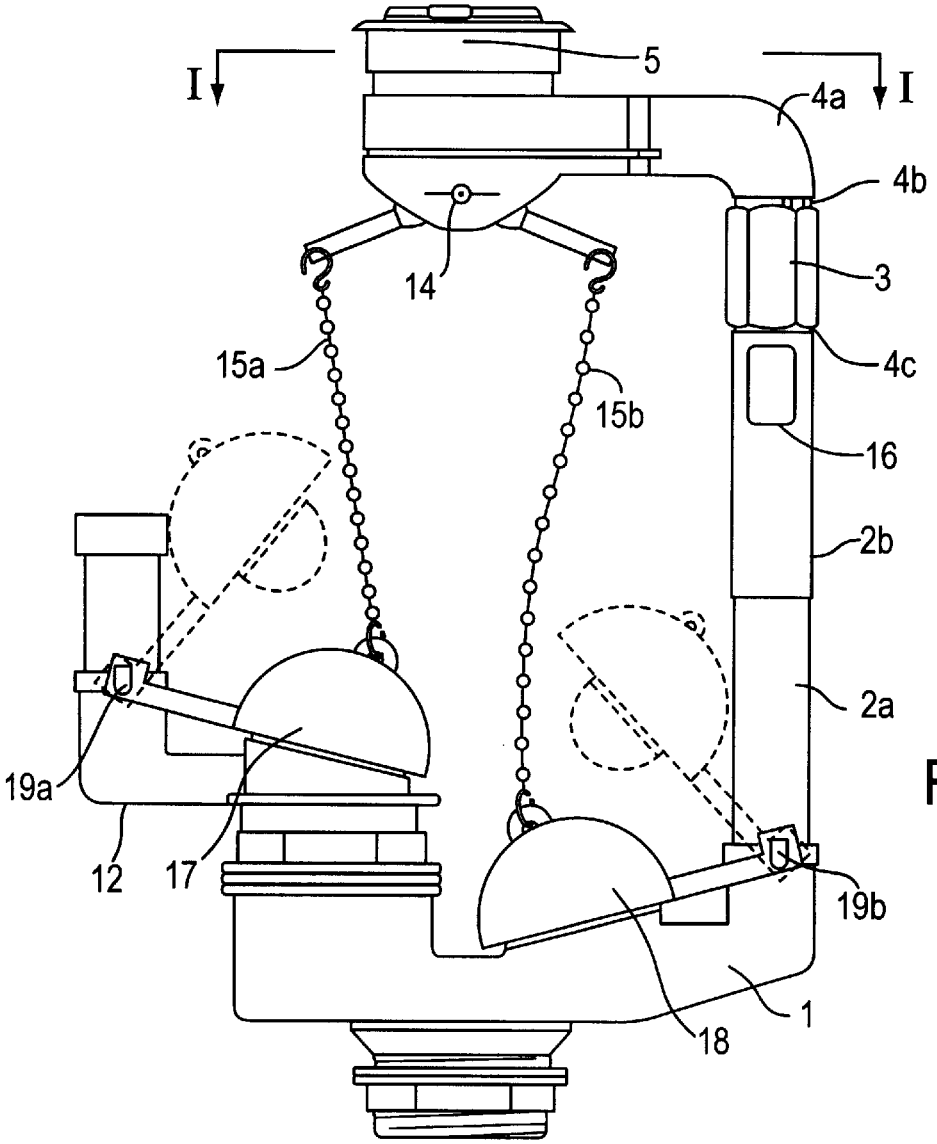
FIG. 1A is a front elevational view of a flush valve constructed in accordance with the present, invention.

Reference is now made to FIGS. 1A through 1C of the drawings which depict a dual flush assembly (1) which fits into a water closet tank, not shown. Dual flush assembly (1) includes an overflow tube, which comprises an upper bending tube member (4*a*) which functions to hold all the elements in the knob assembly and bolt tube members (3, 4*b*, 4*c*) together with a pipe groove, used for regulating the height of the over flow tube (2*a*, 2*b*, 4*a*) which also sets the height of the knob base (5). FIGS. 1B and 1C are the top plan views of the knob member and its base. The tube or overflow channel, with the overflow aperture or door (16), is dual-functioned, acting primarily as an overflow channel and secondarily as a supporting rod and regulator of the desired height of the two flush valve operating knobs (11,13). Assembly (1) also includes an upper flush valve lever chain (15*a*), a lever operating hinge (14), a lower flush valve lever chain (15*b*), an upper flush valve (17) forming a half-circle, and a lower flush valve (18) having the same shape as the former valve. The two flush valves are connected through chains (15*a*, 15*b*) to a single hinge (14) as the pivot element. Aperture (16) regulates the balance of flush water such that a volume of flush water discharged through upper flush valve (17) is approximately 3 liters and a volume of flush water discharged through lower valve (18) is approximately 6 liters.

Figure 2B:
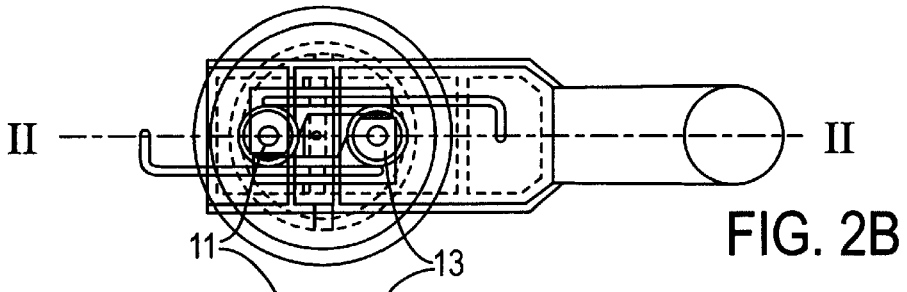
FIG. 2B is a sectional view of FIG. 2A at line II—II.
Figure 2A:
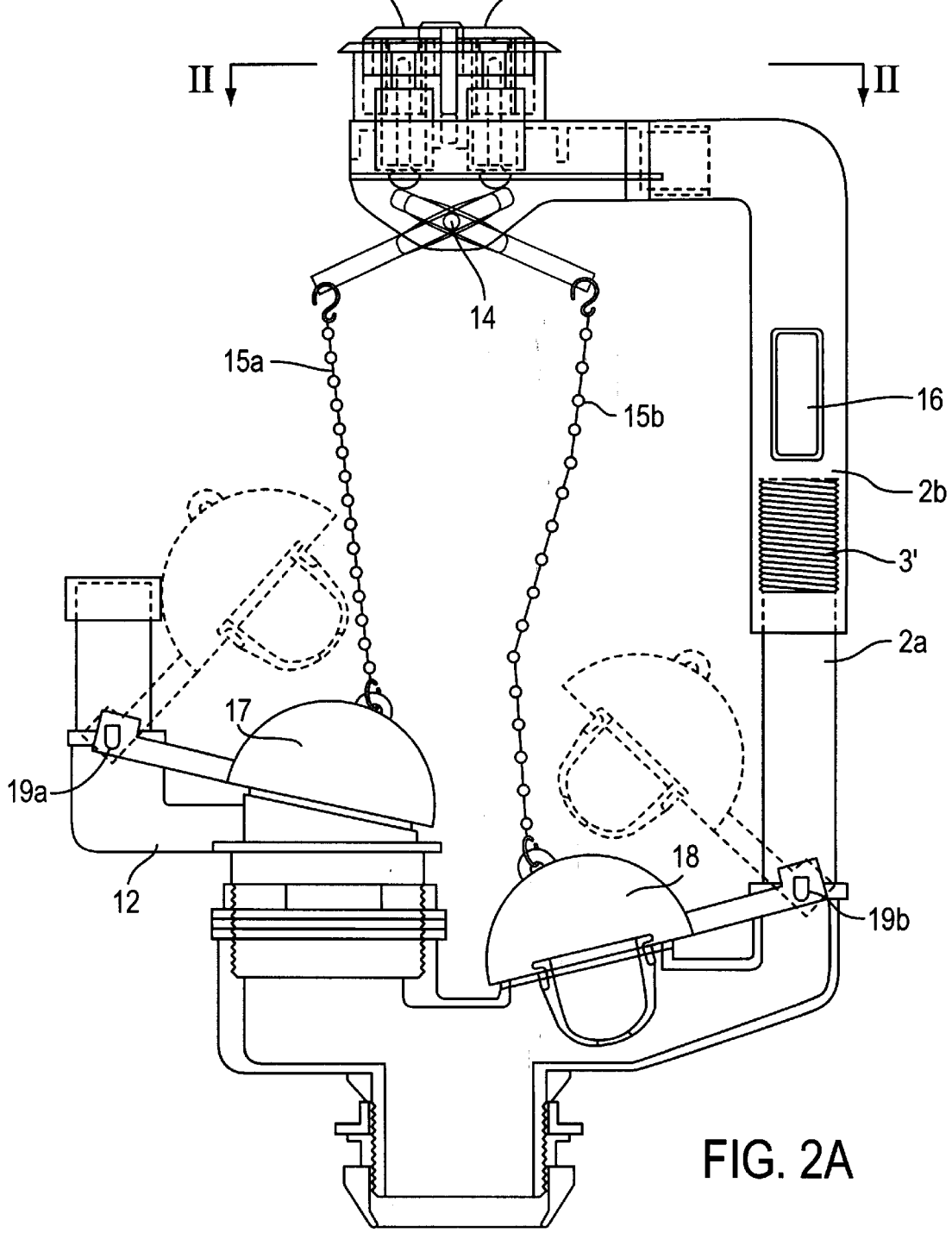
FIG. 2A is a front elevational view of another embodiment of the invention showing a flush valve constructed in accordance with the present invention showing the internal components therein.

FIGS. 2A and 2B are detailed drawings showing the internal elements of the knob component. Assembly (1), shown without the height regulator (4*b*, 4*c*) in the overflow tube (2*a*, 2*b*), is linked by bolt (3') without members (3 and 4*a*).

Figure 3B:
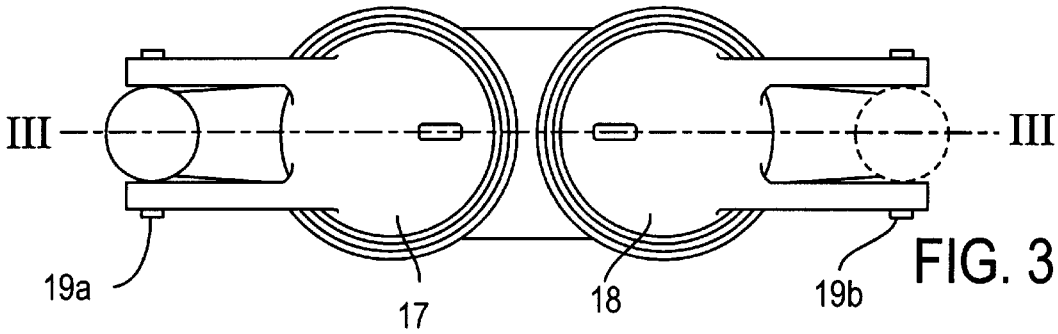
FIG. 3B is a sectional view of FIG. 3A at line III—III.
Figure 3A:
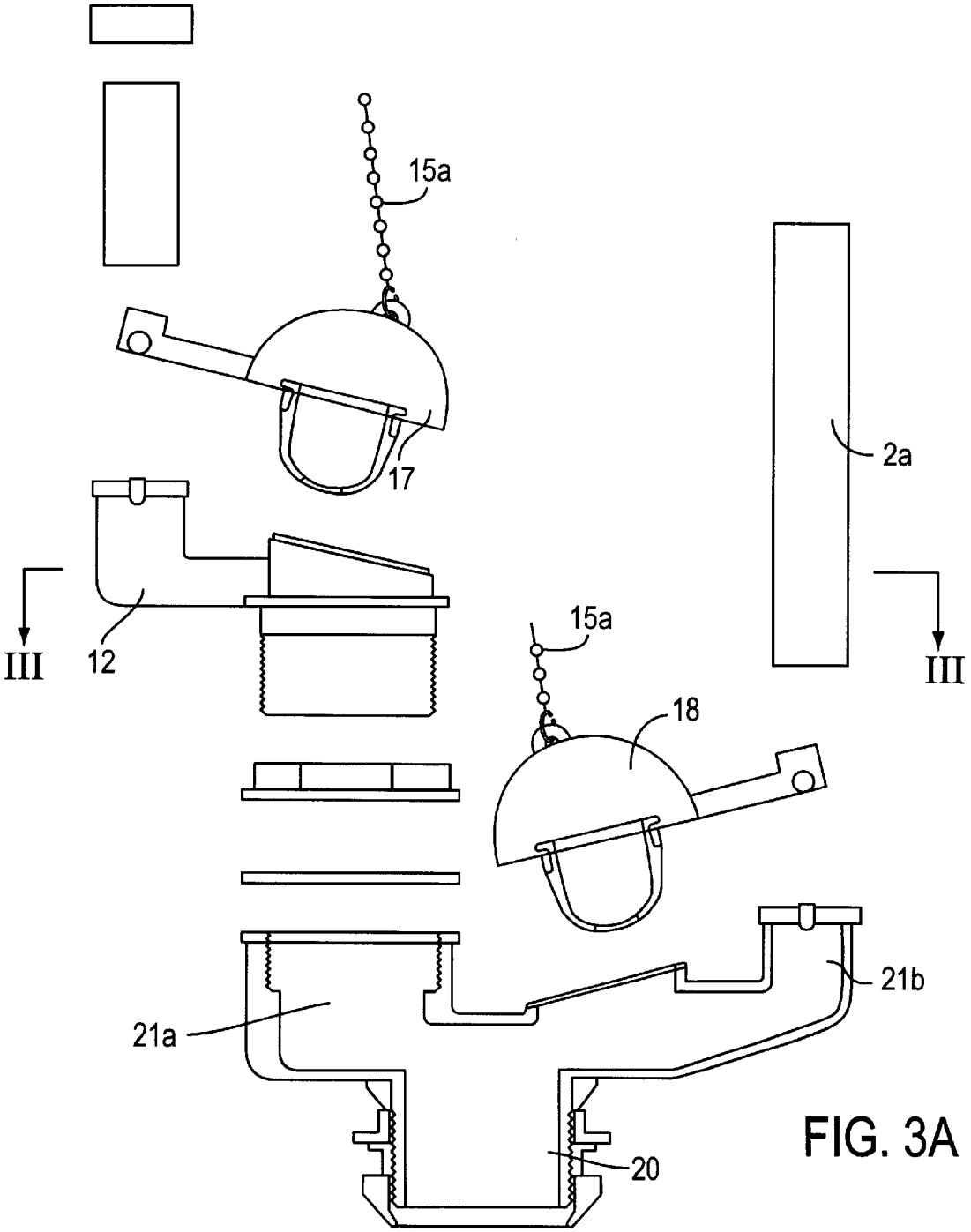
FIG. 3A is an exploded view of the flush valve components.

FIGS. 3A and 3B depict the members belonging to the upper flush valve (17) and the lower flush valve (18), which consist of an upper flush valve hinge member (19*a*), a lower flush valve hinge member (19*b*), an upper flush valve lifting chain (15*a*) a lower flush valve lifting chain (15*b*), an upper flush valve overflow drain tube (21*a*), a lower flush valve overflow drain tube (21*b*), a base tube (12) for the upper flush valve, a flush water overflow tube (2*a*), and a main flush water drain tube (20). Base tube (12) has an axis parallel to the axis in outlet tube (21*a*) and further parallel to the axis in overflow tube (2*a*).

Figure 4B:
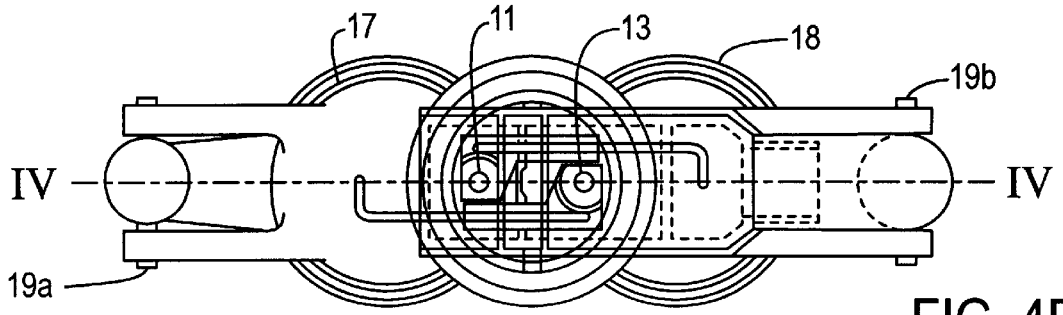
FIG. 4B sectional view of FIG. 4A at section IV—IV.
Figure 4A:
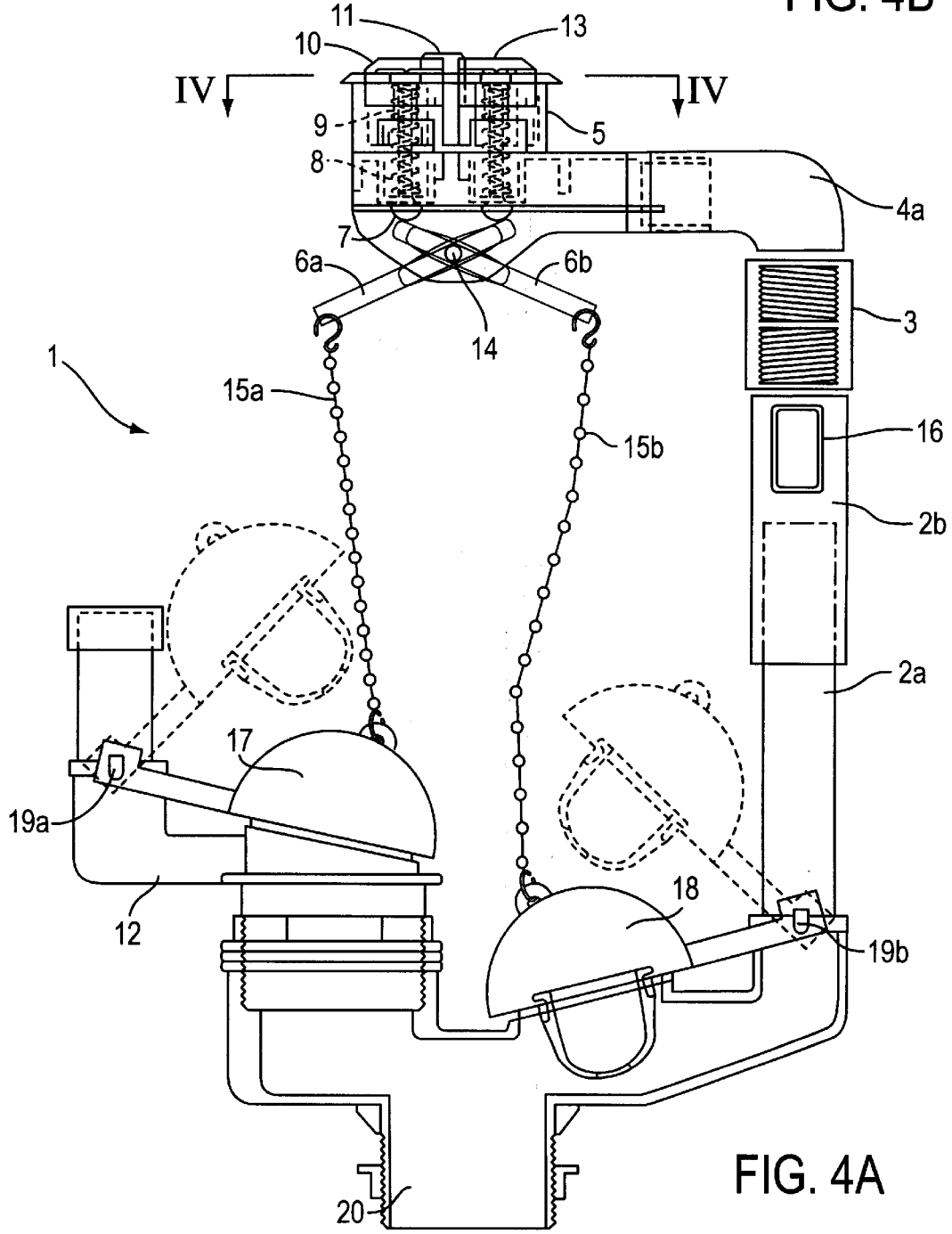
FIG. 4A is a front elevational view of the flush valve shown in FIG. 1A showing the internal components therein.

Reference is now made to FIGS. 4A and 4B which depict a detailed representation of the invention. Knob heads (11, 13) which actuate the upper and lower flush valves (17, 18), if pressed, will push the upper or lower flush valve operating levers (6*a*, 6*b*)which are held by the restoring force of springs (8). A force is exerted on knob pin (23) (shown in FIG. 6A) having a contact surface (7) which will press one of the upper and lower flush valve operating levers (6*a*, 6*b*), which thereby impels the upper or lower flush valve chain (15*a*, 15*b*) to raise the upper or lower flush valve (17, 18). The pivot element of the operating levers (6*a*, 6*b*) is an operating lever hinge (14). Both levers are constructed such that they intersect each other forming an "X" whereby the ratio of the length of the lever member above the pivot point to the length of the lever member below the pivot point is 1:3. Knob (11) located on the left in FIG. 4A actuates the lower flush valve (18) which preferably will discharge at least 6 liters of flush water. Knob (13), located on the right, actuates the upper flush valve (17) which discharges a preferred flush water volume of at least 3 liters.

If desired, the knob base may be adjusted. The height is increased by the rotation of the height adjusting bolt (3) onto the lower part (4*b*) of bend tube (4*a*) and onto the upper part (4*c*) of overflow tube (2*b*)in the clockwise direction. Accordingly, the height is lowered by the rotation of said elements in the counterclockwise direction. The flush valve lever hinge (14) may be a riveted hinge which can rotate on its axis. FIG. 4B depicts the position of the knobs (11, 13) which face one another and are semi-circular in shape to fit within a circular shaped base (5). The shape of the knobs is not limited to any specific shape and may be of any known form.

Figure 5C:
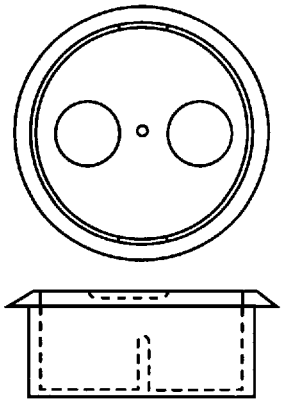
FIG. 5C is an isolated view of the uppermost components of the flush valve of FIG. 4A.
Figure 5B:
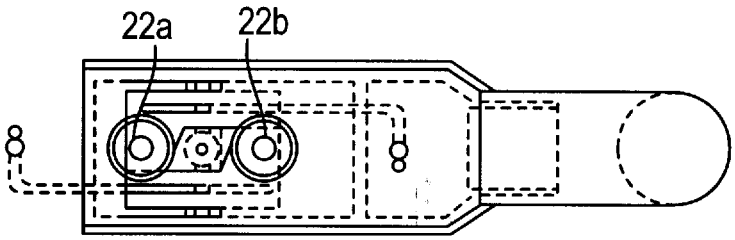
FIG. 5B is a top plan view of FIG. 5A.
Figure 5A:
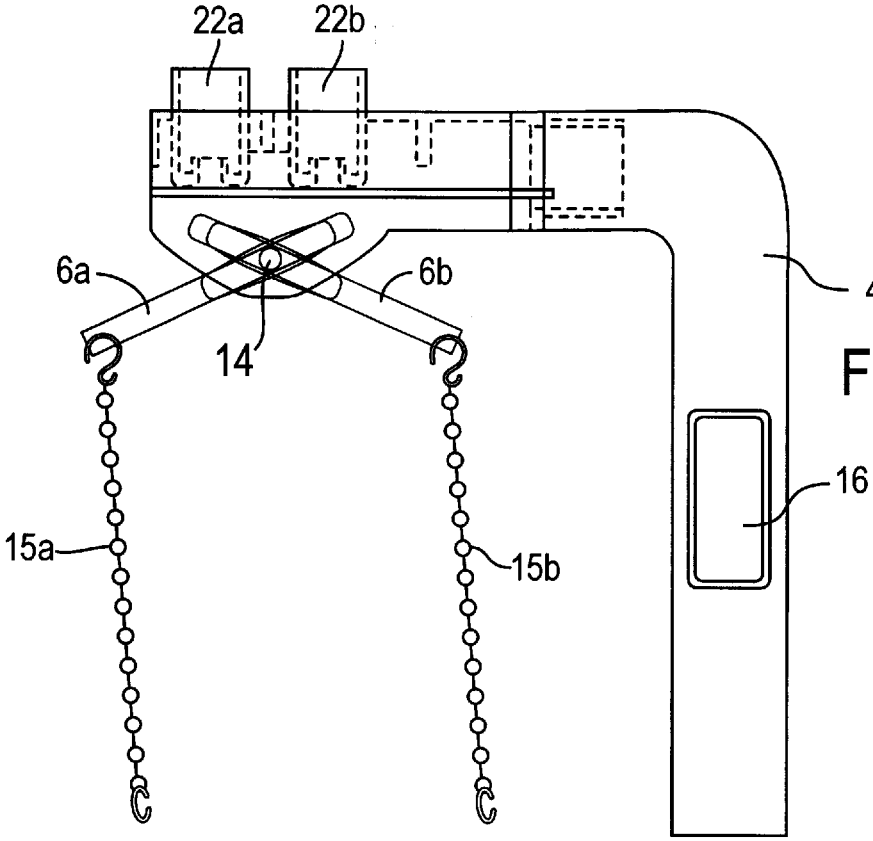
FIG. 5A is a cut-away view of the upper components of the flush valve of FIG. 2A.

FIGS. 5A through 5C represent the members supported by the knob base (5). Flush valve operating knob pin directors (22*a*, 22*b*), function to direct the knob pins (23), (shown in FIG. 6A), to move in the proper direction for actuating levers (6*a* and 6*b*) when one of the knobs (11 or 13) is actuated.

Figure 6B:
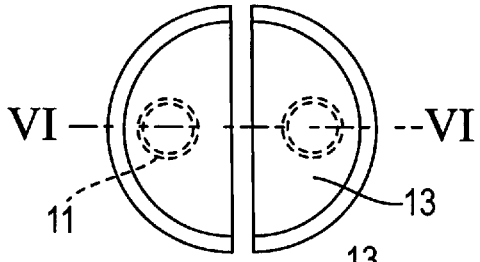
FIG. 6B is a top plan view of the uppermost components of FIG. 4A.
Figure 6A:
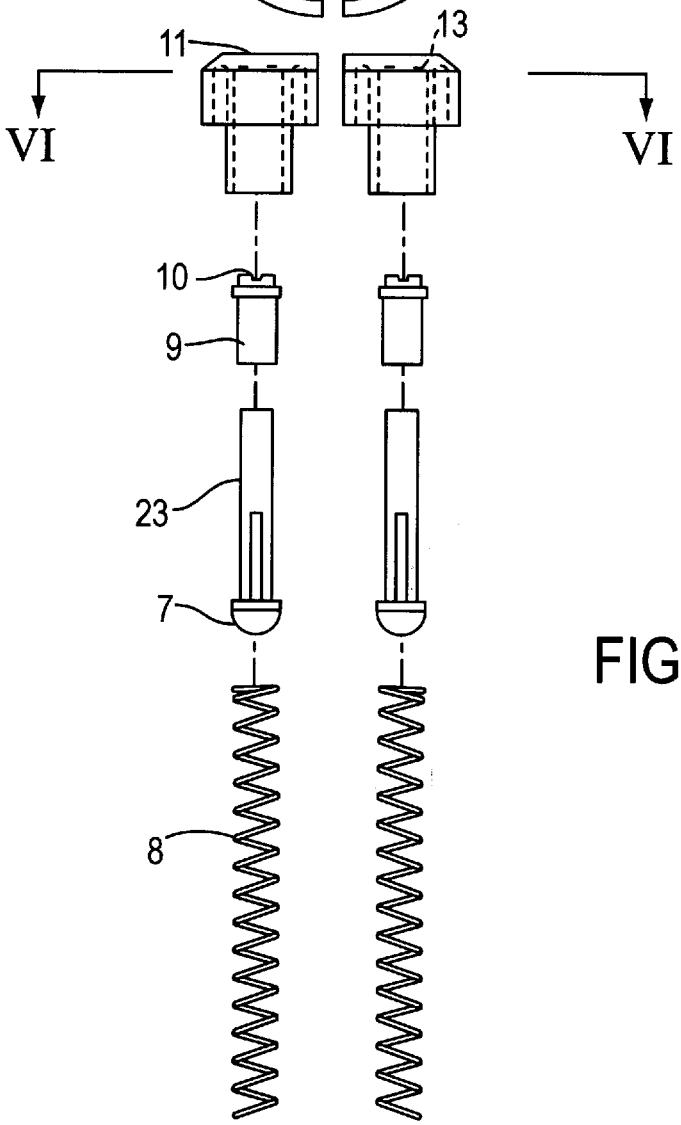
FIG. 6A is an exploded view of the upper components of the flush valve of FIG. 4A at line VI—VI of FIG. 6B.

FIGS. 6A and 6B show knob members including knob heads, pin joint regulating bolts (10), knob pin joints (9), knob pins (23), and knob pin end contact surfaces (7) which contact valve operating levers (6*a*, 6*b*). Restoring springs (8) restore the knobs (11, 13) to their original position after actuation.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A dual flush assembly for use in a water closet tank comprising:

an upper flush valve having an upper outlet;

a lower flush valve having a lower outlet, said lower outlet connected to said upper outlet, said upper and lower outlets further connected to an outlet tube;

an overflow tube connected to said upper and lower outlets, said overflow tube including an aperture for regulating the balance of flush water such that a volume of flush water discharged through said upper valve is approximately 3 liters and a volume of flush water discharged through said lower valve is approximately 6 liters;

a knob base disposed on said overflow tube;

a pair of knobs each including a knob head mounted in said base for actuating said flush valves;

a pair of knob pin joints coupled to said knobs;

a pair of knob pins coupled to said pin joints;

a pair of springs coupled to said knob pins;

a pair of valve operating levers connected to said upper and lower flush valves, said levers movably connected to each other by a hinge;

a pair of chains connected at a first end to said upper and lower valves and at a second end to said levers;

and a knob base height adjuster disposed in said overflow tube.

2. The dual flush assembly of claim 1 wherein a ratio of a length of the levers from a top end thereof to said hinge and a length of the levers from the hinge to the lower end thereof is 1:3.

3. The dual flush assembly of claim 1 wherein said upper flush valve is further coupled to a base tube, said base tube having an axis parallel to an axis in said outlet tube and further parallel to an axis in said overflow tube.

4. The dual flush assembly of claim 1 wherein said upper and lower flush valves are positioned on said respective outlets at inclined positions.

5. The dual flush assembly of claim 1 wherein said height adjuster includes a bolt means linked to said overflow tube.

6. The dual flush assembly of claim 5 wherein said overflow tube includes a bending tube member at an upper end thereof.

7. The dual flush assembly of claim 6 wherein said bolt means is inserted between said bending tube member and a lower end of said overflow tube.

* * * * *